US006634589B2

(12) United States Patent
Hiraoka et al.

(10) Patent No.: US 6,634,589 B2
(45) Date of Patent: Oct. 21, 2003

(54) INK FILM HOLDING DEVICE AND FILM REEL

(75) Inventors: Jun Hiraoka, Nara (JP); Takashi Suda, Kashihara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/011,289

(22) Filed: Dec. 11, 2001

(65) Prior Publication Data

US 2003/0047635 A1 Mar. 13, 2003

(30) Foreign Application Priority Data

Sep. 12, 2001 (JP) ..... P2001-276981

(51) Int. Cl.[7] ..... B41J 35/08

(52) U.S. Cl. ..... 242/423.1; 242/423.2; 242/538.1

(58) Field of Search ..... 242/423.1, 423.2, 242/538.1, 538.2, 538.3, 422.4

(56) References Cited

U.S. PATENT DOCUMENTS 4,015,792 A * 4/1977 Thenon et al. ..... 242/538.1
4,116,749 A * 9/1978 Dufort et al. ..... 156/555
4,755,833 A * 7/1988 Tanigawa et al. ..... 347/176
5,374,007 A * 12/1994 Murison ..... 242/538.2
5,667,318 A * 9/1997 Tanno et al. ..... 400/208
5,974,963 A * 11/1999 Kawai ..... 101/128.1
6,257,780 B1 * 7/2001 Ito et al. ..... 400/208
6,307,581 B1 * 10/2001 Uchiyama et al. ..... 347/214

FOREIGN PATENT DOCUMENTS

| | | |
|---|---|---|
| EP | 0586351 A2 | 3/1994 |
| EP | 0931672 A1 | 7/1999 |
| JP | A11-208049 | 8/1999 |
| JP | A11-208050 | 8/1999 |

* cited by examiner

*Primary Examiner*—Kathy Matecki
*Assistant Examiner*—Sang Kim
(74) *Attorney, Agent, or Firm*—Birch, Stewart, Kolasch & Birch, LLP

(57) ABSTRACT

A first supporting member is mounted detachably to one axial end of a supply reel around which an ink film is wound. The first supporting member has a rotating portion generating a braking force to rotation. A second supporting member is mounted detachably to a second axial end of the supply reel, and rotatably supports the second axial end of the supply reel. A winding reel winds up the ink film guided to it from the supply reel. A third supporting member is mounted detachably to one axial end of the winding reel and is rotated in a predetermined winding direction. A fourth supporting member is mounted detachably to a second axial end of the winding reel and rotatably supports the second axial end of the winding reel. The first and third supporting members are detachably supported by a first side plate, and the second and fourth supporting member and fastened to a second side plate.

12 Claims, 7 Drawing Sheets

INK FILM HOLDING DEVICE AND FILM REEL

BACKGROUND OF THE INVENTION

1. Field of the Invention

The present invention relates to an ink film holding device and an ink film reel that can be suitably implemented in a line printer-type thermal transfer printing apparatus mounted to a communications apparatus and an information processing apparatus having an image printing function, such as a facsimile, a printer or a copier.

2. Description of the Related Art

FIG. 8 is an exploded perspective view showing a conventional art ink film holding device 1. This holding device 1 includes a supply reel 3 around which an ink film 2 is wound, a first supporting member 4 fitted to one axial end of the supply reel 3, a second supporting member 5 fitted to the other axial end of the supply reel 3, a winding reel 6 that is arranged parallel to the supply reel 3 and around which the ink film 2 is wound that is unwound from the supply reel 3, a third supporting member 7 fitted to one axial end of the winding reel 6, a fourth supporting member 8 fitted to the other axial end of the winding reel 6, and a rotation driving source 9 that rotates the third supporting member 7 around its axis in a pre-determined winding direction A.

The first supporting member 4 includes a right cylindrical portion 11, a ring-shaped flange 12 that is fastened to an intermediate portion between the two ends of the right cylindrical portion 11, and a gear wheel 13 fastened to one axial end of the cylindrical portion 11. The second supporting member includes a right cylindrical portion 15, and a ring-shaped flange 16 that is fastened to an intermediate portion between the two ends of the right cylindrical portion 15. The third supporting member 7 includes a right cylindrical portion 18, and a ring-shaped flange 19 that is fastened to an intermediate portion between the two ends of the right cylindrical portion 18. The fourth supporting member 8 includes a right cylindrical portion 21, a ring-shaped flange 22 that is fastened to an intermediate portion between the two ends of the right cylindrical portion 21, and a gear wheel 23 fastened to one axial end of the cylindrical portion 21.

The gear wheel 23 of the fourth supporting member 8 meshes with a gear wheel (not shown in the drawing) of the rotation driving source 9, which is configured so as to rotate the winding reel 6 in a winding direction A in synchronization with the printing speed, winding the ink film 2 that has been drawn out and transferred from the supply reel 3. The gear wheel 13 of the first supporting member 4 meshes with a gear wheel 35 of a back tension mechanism (not shown in the drawings), which applies a certain tension on the ink film 2 during the printing, and prevents slack or wrinkles in the ink film 2.

The supply reel 3 and the winding reel 6 are arranged in parallel at a certain spacing to one another, and side plates 25 and 26 are arranged at right angles to their axes on both sides in axial direction of the supply reel 3 and the winding reel 6. Substantially U-shaped cutouts 27 to 30 that are open to the top (upward direction in FIG. 8) are formed in the side plates 25 and 26. The cylindrical portions 11, 15, 18 and 21 of the first to fourth supporting members 4, 5, 7 and 8 are fitted detachably into these cutouts 27 to 30.

The portions of the cylindrical portions 11, 15, 18 and 21 protruding inward from opposing inner walls of the side plates 25 and 26 are fitted into the axial ends of the supply reel 3 and the winding reel 6. In this situation, the flanges 12, 16, 19 and 22 of the first to fourth supporting members 4, 5, 7 and 8 are supported by outward-facing outer walls of the side plates 25 and 26. The first and second supporting members 4 and 5 are arranged on a common axis with the supply reel 3 and rotatably support the supply reel 3 around which the ink film 2 is wound. The third and fourth supporting members 7 and 8 are arranged on a common axis with the winding reel 6 and rotatably support the winding reel 6 around which the ink film 2 is wound.

Such a holding device 1 can be installed in a line printer-type thermal transfer printing apparatus mounted to a communications apparatus, such as a facsimile, or an information processing apparatus, such as a printer or a copier, which have an image printing function.

Another example of conventional technology is disclosed in Japanese Unexamined Patent Publication JP-A 11-208049 (1999). In this conventional technology, the holding device includes two side plates, a supply reel around which an ink film is wound, a winding reel winding the ink film guided to it from the supply reel, four supporting members mounted to the respective two axial ends of the supply reel and the winding reel, and two side plates holding the supporting members mounted to the respective two axial ends of the supply reel and the winding reel. The supporting members are arranged on the opposing inner sides of the two side plates, and the holding device has an integrated structure, in which the supporting members do not protrude from the outer side walls of the side plates, thereby making it possible to make the holding device smaller and facilitating the task of exchanging the ink film.

Yet another example of conventional technology is disclosed in Japanese Unexamined Patent Publication JP-A 11-208050 (1999). In this conventional technology, the holding device includes two side plates, a supply reel around which an ink film is wound, a winding reel winding the ink film guided to it from the supply reel, four supporting members mounted to the respective two axial ends of the supply reel and the winding reel, and two side plates holding the supporting members mounted to the respective two axial ends of the supply reel and the winding reel. Two of the four supporting members that are provided with gear wheels and are arranged on one side are tiltably attached to one side plate, sandwiching this side plate with the gear wheels and with flanges. Thus, only the supporting members mounted to the other side plate have to be removed when exchanging the ink film, so that the task of detaching and attaching the supply reel and the winding reel can be facilitated.

In the conventional technology shown in FIG. 8, the task of detaching and the task of attaching the first to fourth supporting members 4, 5, 7 and 8 when exchanging the ink film has to be carried out at a total of four locations, namely the two axial ends of the supply reel 3 and the two axial ends of the winding reel 6, so that there is the problem that these tasks take considerable time, and the workability of the ink film exchange is poor. Furthermore, according to this conventional technology, the body of an apparatus on which the ink film holding device is mounted is provided with a rotation driving source 9 as a mechanism for applying back tension to the first supporting member on the supply reel side, so that there is the problem that the number of components is large, and the apparatus becomes larger because the space taken up by these components in the apparatus body is large.

Furthermore, in the conventional technology disclosed in JP-A 11-208049, the holding device has an integrated structure in which the supporting members are provided on the side plates, so that when changing the ink film, the supporting members mounted to the side of the one axial end of the supply reel and the winding reel and the supporting members mounted to the side of the other axial end of the supply reel and the winding reel are mounted to the respective side plates, so that it is necessary to carry out the tasks of detaching them from the supply reel and the winding reel and then attaching them again. During these tasks, the side plates and the supporting members have to be held simultaneously with one hand, so that there is the problem that the operability is poor, and the exchanging of the ink film takes considerable time. Also in this conventional technology, as shown in the conventional technology shown in FIG. 8, the number of components is large, because the apparatus body has to be provided with a back tension mechanism, and since it takes up space in the apparatus body, there is the problem that the apparatus becomes larger.

Moreover, in the conventional technology shown in JP-A 11-208050, the two supporting members mounted to the one axial ends of the supply reel and the winding reel are provided on one side plate, so that when exchanging the ink film, even though it is not necessary to detach the supporting members arranged on the side of the one axial end from the supply reel and the winding reel and then to attach them again, these supporting members are attached in a loose and tiltable fashion to the side plate, so that when attaching them, the supporting members that are not attached firmly to the side plate have to be mounted while holding the supply reel and the winding reel, precisely positioning their axial orientations. Thus, there is the problem is that the operability is poor, and the exchanging of the ink film takes considerable time. Also in this conventional technology, as in the conventional technologies shown in FIG. 8 and in JP-A 11-208049, the number of components is large, because the apparatus body has to be provided with a back tension mechanism, and since it takes up space in the apparatus body, there is the problem that the apparatus becomes larger.

In the conventional technologies in FIG. 8, in JP-A 11-208049, and in JP-A 11-208050, the supply reel and the winding reel are roughly of right cylindrical shape, and the supporting members include a cylindrical fitting portion fitting into the respective two axial ends of the supply reel and the winding reel, a flange abutting against the end faces of the axial ends of the supply reel and the winding reel, and a bearing supported by the side plate.

With such supporting members, both axial ends of the supply reel and the winding reel are supported rotatably by the side plates, so that between the side plates and the end faces of both axial ends of the supply reel as well as between the side plates and the end faces of both axial ends of the winding reel, there are the flanges and small gaps of a size allowing rotation of the supply reel and the winding reel. This configuration determines the spacing between the side plates and the apparatus body, so that sufficient space has to be ensured in the apparatus body, so that the side plates can be arranged at that distance, and there is the problem that the apparatus cannot be made smaller.

SUMMARY OF THE INVENTION

It is an object of the invention to provide an ink film holding device and an ink film reel which allow improvement of the workability of exchanging the ink film and the downsizing of an apparatus on which the ink film holding device is mounted.

The invention provides an ink film holding device comprising:

a supply reel around which an ink film is wound;

a first supporting member that is mounted detachably to one axial end of the supply reel and includes a rotating portion that is fitted to the one axial end of the supply reel and generates a braking force with respect to rotation around the axis of the supply reel;

a second supporting member that is mounted detachably to the other axial end of the supply reel, for supporting the other axial end of the supply reel such that the other axial end is rotatable about the axis of the supply reel;

a winding reel that is arranged parallel to the supply reel, for winding up the ink film that is guided to the winding reel from the supply reel;

a third supporting member that is mounted detachably to one axial end of the winding reel and is rotated in a predetermined winding direction;

a fourth supporting member that is mounted detachably to the other axial end of the winding reel, for supporting the other axial end of the winding reel such that the other axial end is rotatable about the axis of the winding reel;

a first side plate for supporting the first supporting member and the third supporting member such that the first and third supporting members are rotatable about their respective axes; and a second side plate to which the second supporting member and the fourth supporting member are fastened.

In accordance with this invention, the supply reel and the winding reel are arranged in parallel between the first side plate and the second side plate, and the ink film that is wound around the supply reel is collected by being wound around the winding reel. The supply reel and winding reel between the first and second side plates can be replaced by a new supply reel around which a new ink film is wound and a new winding reel around which no ink film is wound.

In this ink film holding device, the first supporting member is mounted to the one axial end of the supply reel, and the second supporting member is mounted to the other axial end of the supply reel. The third supporting member is mounted to the one end of the winding reel, and the fourth supporting member is mounted to the other end of the winding reel. The first supporting member and the third supporting member are supported rotatably about their axes by the first side plate, whereas the second supporting member and the fourth supporting member are fastened to the second side plate.

Consequently, the first supporting member, which is mounted to the one axial end of the supply reel, is rotatably supported by the first side plate, whereas the other axial end of the supply reel is rotatably supported by the second supporting member, thus allowing rotation of the supply reel around its axis. Also, the third supporting member, which is mounted to the one axial end of the winding reel, is rotatably supported by the first side plate, whereas the other axial end of the winding reel is rotatably supported by the fourth supporting member, thus allowing rotation of the winding reel around its axis.

When the third supporting member is rotated in a predetermined winding direction, its rotation is transmitted to the winding reel, which winds up an ink film that is guided to the winding reel from the supply reel, so that the supply wheel follows this rotation due to the tension of the ink film. In this situation, the rotating portion of the first rotating member rotates together with the supply wheel, but a braking force acts on the rotation of this rotating portion, so that the rotation of the supply wheel is braked, whereby a tension is generated in the ink film that is spanned between the supply reel and the winding reel, namely a so-called back tension is applied. Thus, wrinkles or slack in the ink film in the region in which the ink of the ink film is transferred to the paper can be prevented, and printing defects such as displacements or irregularities in the printed image can be prevented.

This braking force on the rotation of the supply reel for applying back tension to the ink film is achieved with the first supporting member, so that it is not necessary to provide the apparatus body of the apparatus on which the holding device is installed with a back tension mechanism for braking the rotation of the supply reel. Consequently, space in the apparatus body is not taken up by such a back tension mechanism, and it is possible to make the apparatus smaller. Furthermore, when the ink film is exchanged, the task of detaching/attaching the other axial end of the supply reel and the second supporting member as well as the task of detaching/attaching the other axial end of the winding reel and the fourth supporting member are simplified compared to the case where the second supporting member and the fourth supporting member are taken off individually, because the second supporting member and the fourth supporting member are fastened to the second side plate, thus making the task of exchanging the ink film easier, and improving the workability of the apparatus.

In the invention it is preferable that the supply reel is provided with a bearing portion that is rotatably supported by the second supporting member and that is located closer to the one axial end of the supply reel than the other axial end of the supply reel.

According to the invention, because the bearing portion on the other axial end of the supply reel, which is supported by the second supporting member, is formed closer to the one axial end than the other axial end, the bearing portion is more receded to the one axial end than the side face of the other axial end of the supply reel, and consequently, the other axial end of the supply reel is supported with the second supporting member being fitted into the other axial end of the supply reel. Thus, the spacing between the end face of the other axial end of the supply reel and the second side plate on which the second supporting member is provided can be reduced by the distance that the bearing portion is receded from the end face of the other axial end of the supply reel toward the one axial end, the second side plate on which the second supporting member is provided can be placed closer to the first side plate, the space taken up by the holding device can be reduced, and an apparatus on which the holding device is installed can be made smaller.

In the invention, it is preferable that the second supporting member is tapered as it protrudes from the second side plate.

According to the invention, because the second supporting member is tapered, the other axial end of the supply reel can be easily mounted to the second supporting member, so that the supply reel can be easily mounted when exchanging the ink film. Furthermore, by making the second supporting member tapered, the bearing portion is supported by the tip of the second supporting member, so that the rotation axis of the supply reel matches the axis of the second supporting member, achieving a smooth rotation of the supply reel, preventing variations in the tension force on the ink film spanned between the supply reel and the winding reel, and decreasing printing defects.

In the invention, it is preferable that the fourth supporting member is tapered as it protrudes from the second side plate.

According to the invention, because the fourth supporting member is tapered, the other axial end of the winding reel can be easily mounted to the fourth supporting member, facilitating the task of mounting the winding reel when exchanging the ink film.

In the invention, it is preferable that an outer diameter of the second supporting member at a fitting position where the second supporting member is completely mounted to the other axial end of the supply reel is different from the outer diameter of the fourth supporting member at a fitting position where the fourth supporting member is completely mounted to the other axial end of the winding reel, and the inner diameter of the other axial end of the supply reel and the inner diameter of the other axial end of the winding reel are formed slightly bigger than the outer diameter of the second supporting member at the supply reel fitting position and the outer diameter of the fourth supporting member at the winding reel fitting position.

According to the invention, the outer diameter of the second supporting member at the supply reel fitting position is different from the outer diameter of the fourth supporting member at the winding reel fitting position, and the inner diameter of the other axial end of the supply reel and the inner diameter of the other axial end of the winding reel are formed slightly bigger than the outer diameter of the second supporting member at the supply reel fitting position and the outer diameter of the fourth supporting member at the winding reel fitting position, so that, even when trying to mount the fourth supporting member to the supply reel or when trying to mount the second supporting member to the winding reel, insertion is impossible or the fitting is too loose. Accordingly the user easily recognizes the false mounting, and loading errors of the supply reel and the winding reel can be prevented.

In the invention, it is preferable that the second side plate is fastened to an apparatus body of an apparatus for printing using the ink film.

According to the invention, the task of detaching/attaching the second and fourth supporting members from/to the supply reel and the winding reel when exchanging the ink film can be omitted, thus decreasing the number of parts that are mounted to or removed from the supply reel and the winding reel when exchanging the ink film, the operation can be simplified, and the workability of the ink film exchange is improved.

In the invention it is preferable that the apparatus body is provided with an openable lid for covering at least a region accommodating the first supporting member, and the lid is provided with an engaging member that rotates the rotating portion of the first supporting member in a predetermined direction unrolling the ink film when opening the lid, and rotates the rotating portion of the first supporting member in a winding direction that is opposite to the unrolling direction when closing the lid.

According to the invention, the lid is provided with an engaging member, so that as a result of opening the lid in the course of exchanging the ink film, the rotating portion of the first supporting member is rotated by the engaging member in an unrolling direction and the ink film that is spanned between the supply reel and the winding reel can be slackened. On the other hand, when the ink film has been exchanged and the lid is closed, the rotating portion of the first supporting member is rotated by the engaging member in a winding direction and a tension can be applied to the ink film that is spanned in a slack state between the supply reel and the winding reel, so that before beginning the next printing operation, wrinkles or slack in the ink film can be prevented.

In the invention it is preferable that the inner diameter of the one axial end of the supply reel is chosen to be larger than the inner diameter of the other axial end of the supply reel.

According to the invention, it is impossible to mount the first supporting member to the other axial end of the supply reel, because the inner diameter of the one axial end of the supply reel is larger than the inner diameter of the other axial end of the supply reel, so that false mounting can be prevented.

In the invention it is preferable that the supply reel and the winding reel are mounted at least to the first side plate together with the first supporting member and the third supporting member and formed in one unit.

According to the invention, the ink film can be exchanged easily and fast, because the supply reel and the winding reel are mounted with the first supporting member and the third supporting member to the first side plate together and formed in one unit.

The invention provides an ink film reel comprising a right cylindrical reel body around which an ink film is wound, two axial ends of the reel body being supported by a supporting member on an apparatus body of an apparatus for printing with the ink film, so as to rotate around an axis of the reel body, wherein one axial end of the reel body is provided with a bearing portion that is more receded to the other axial end than an end face of the one axial end, and that is supported rotatably about the axis of the reel body by a tip of the supporting member.

According to the invention, because the bearing portion on the other axial end, which is supported by the supporting member of the ink film reel, is formed closer to the one axial end than the other axial end, the bearing portion is more receded to the one axial end than the side face of the other axial end of the ink film reel, and consequently, when the supporting member is fitted into the other axial end of the ink film reel, the other axial end of the ink film reel is supported. Thus, the spacing between the end face of the other axial end of the ink film reel and the side plate on which the supporting member is provided can be reduced by the distance that the bearing portion is receded from the end face of the other axial end of the ink film reel toward the one axial end, the side plates on which supporting member is provided can be placed closer one another, the space taken up by the holding device can be reduced, and an apparatus on which the holding device is installed can be made smaller.

In the invention it is preferable that the ink film reel is made of a thermoplastic synthetic resin.

According to the invention, it is possible to reuse the ink film reel after the ink film has been exchanged, because the ink film reel is made of a thermoplastic synthetic resin, thus improving economic efficiency.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
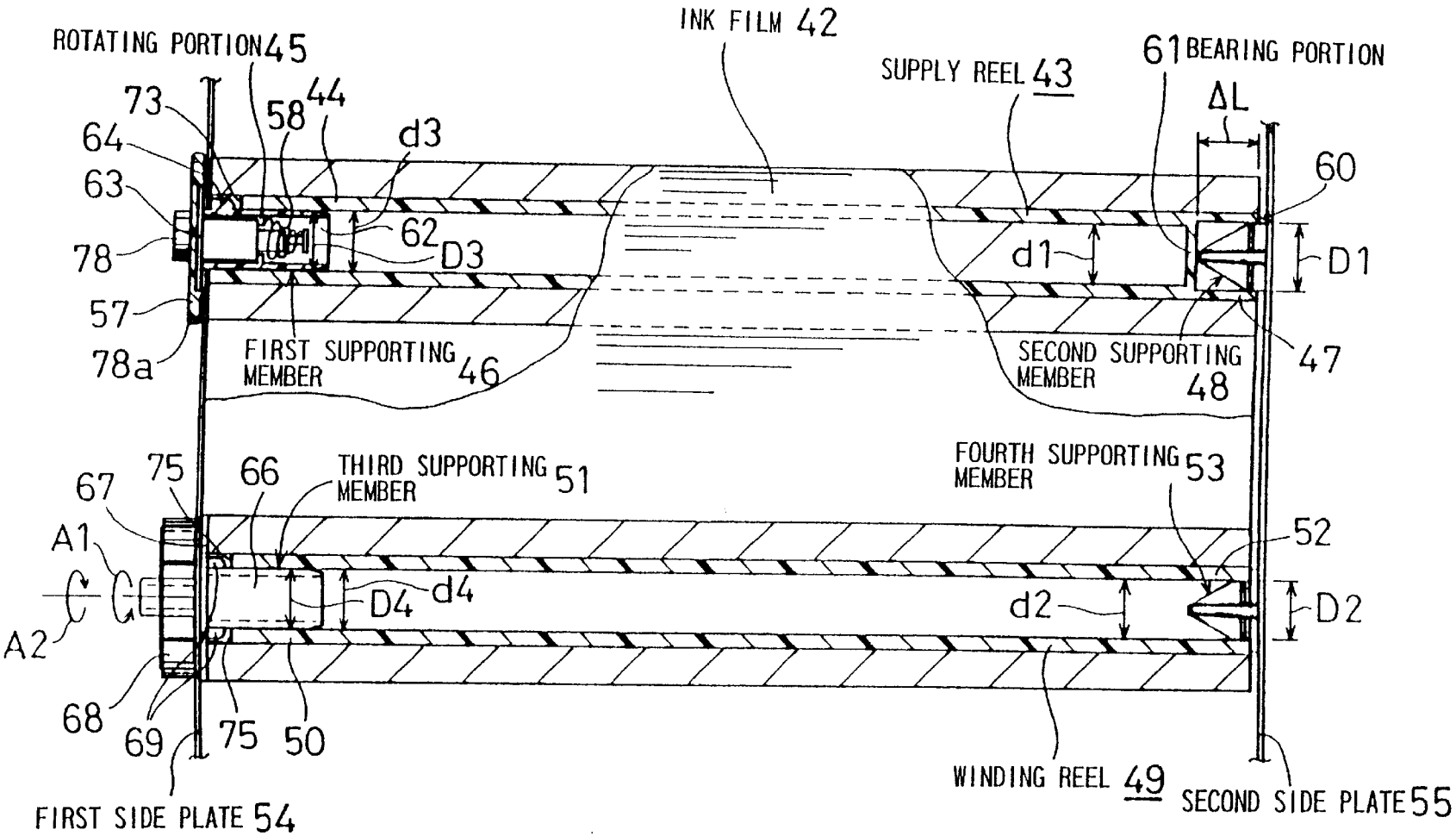
FIG. 1 is a cross-sectional view showing an ink film holding device according to an embodiment of the invention.

Now referring to the drawings, preferred embodiments of the invention are described below.

Figure 2:
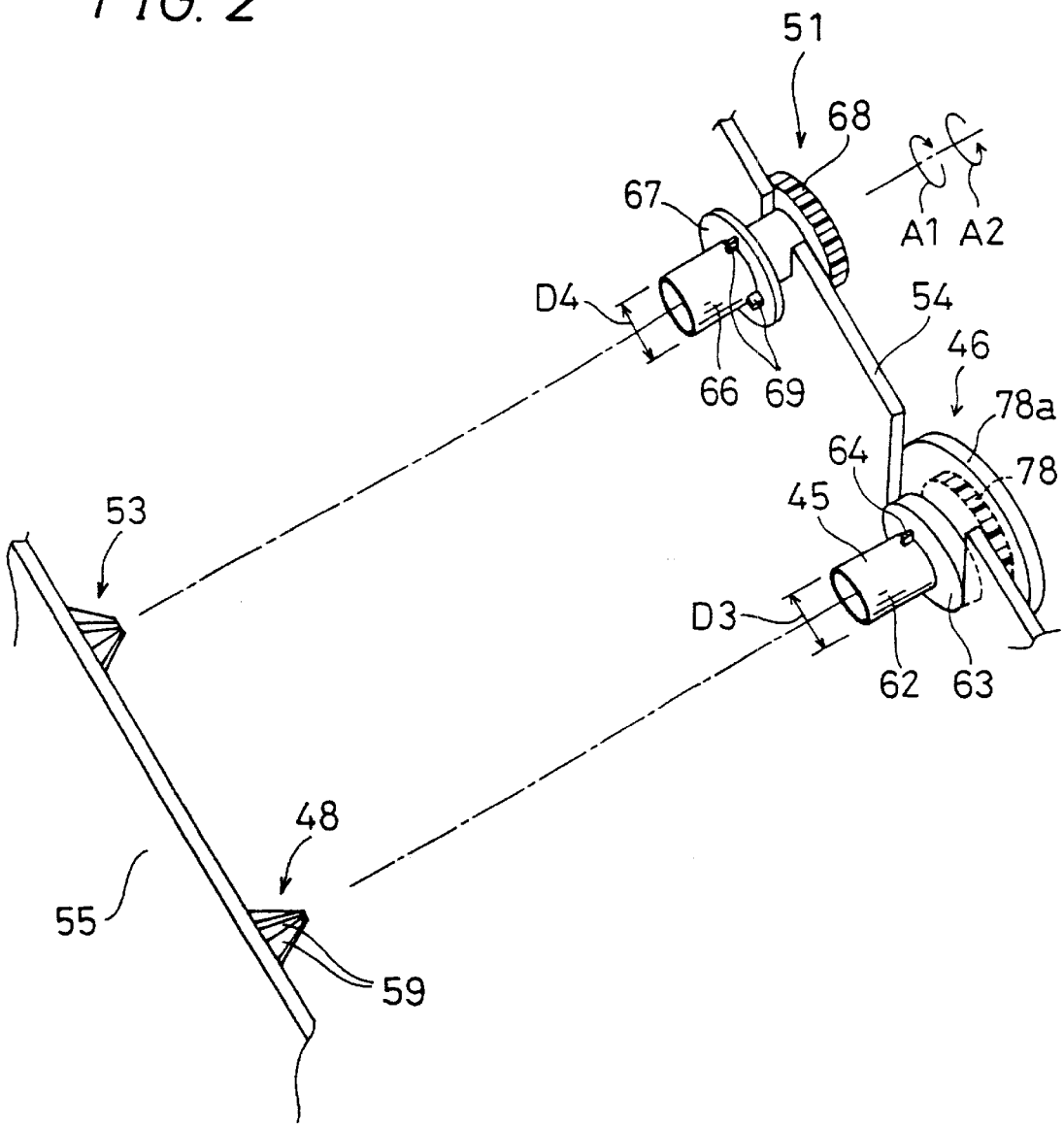
FIG. 2 is a perspective view showing first to fourth supporting members provided on a first side plate and a second side plate.

FIG. 1 is a cross-sectional view showing an ink film holding device 41 according to an embodiment of the invention, and FIG. 2 is a perspective view showing first to fourth supporting members 46, 48, 51 and 53 provided on a first and a second side plate 54 and 55. The ink film holding device 41 of this embodiment includes a supply reel 43, a rotating portion 45, a first supporting member 46, a second supporting member 48, a winding reel 49, a third supporting member 51, a fourth supporting member 53, a first side plate 54, and a second side plate 55. An ink film 42 is wound around the supply reel 43. The rotating portion 45 is fitted into one axial end 44 of the supply reel 43 and generates a braking force when rotating around that axis. The first supporting member 46 is mounted detachably to the one axial end 44 of the supply reel 43. The second supporting member 48 is mounted detachably to the other axial end 47 of the supply reel 43, and supports the other axial end 47 of the supply reel 43 such that it is rotatable around that axis. The winding reel 49 is arranged parallel to the supply reel 43 and winds up the ink film 42 that is guided to it from the supply reel 43. The third supporting member 51 is mounted detachably to one axial end 50 of the winding reel 49 and is rotated in a predetermined winding direction A1. The fourth supporting member 53 is mounted detachably to the other axial end 52 of the winding reel 49 and supports the other axial end 52 of the winding reel 49 such that it is rotatable around that axis. The first side plate 54 supports the first and third supporting members 46 and 51 such that they are rotatable around their respective axes. The second supporting member 48 and the fourth supporting member 53 are fastened to the second side plate 55.

The supply reel 43 is provided with a bearing portion 61 that is rotatably supported by the second supporting member 48 and that is located closer to the one axial end 44 than the end face 60 of the other axial end 47. The second supporting member 48 and the fourth supporting member 53 are formed protruding from the inner wall of the second side plate 55 opposing the first side plate 54 and taper off as they approach the first side plate 54.

The outer diameter D1 of the second supporting member 48 at the supply reel fitting position where the second supporting member 48 is completely mounted to the supply reel 43 is different from the outer diameter D2 of the fourth supporting member 53 at the winding reel fitting position where the fourth supporting member is completely mounted to the winding reel 49, and the inner diameter d1 of the other axial end 47 of the supply reel 43 and the inner diameter d2 of the other axial end 52 of the winding reel 49 are formed slightly bigger than the outer diameter D1 of the second supporting member 48 at the supply reel fitting position and the outer diameter D2 of the fourth supporting member 53 at the winding reel fitting position. The outer diameter D1 of the second supporting member 48 at the supply reel fitting position is set to for example 15 mm, and the outer diameter D2 of the fourth supporting member 53 at the winding reel fitting position is set to for example 13 mm.

Also, the inner diameter d1 of the other axial end 47 of the supply reel 43 and the inner diameter d2 of the other axial end 52 of the winding reel 49 are slightly bigger than the outer diameter D1 of the second supporting member 48 at the supply reel fitting position and the outer diameter D2 of the fourth supporting member 53 at the winding reel fitting position is mounted, and the inner diameter d1 of the supply reel 43 is set for example to D1+0.1 mm, whereas the inner diameter d2 of the winding reel 49 is set for example to D2+0.1 mm.

The first supporting member 46 includes the afore-mentioned rotating portion 45 as well as an open/close actuator 57, and a back tension spring 58. The rotating portion 45 rotates together with the rotation of the supply wheel 43. The open/close actuator 57 is mounted coaxially to this rotating portion 45. The back tension spring 58 presses the rotating portion 45 by spring force against the open/close actuator 57, thus applying a braking force from the open/close actuator 57 on the rotating portion 45 in a direction opposite to the rotation direction when the rotating portion 45 rotates. The back tension spring 58 is realized by a compression coil, and presses the rotating portion 45 with a substantially constant spring force in axial direction against the open/close actuator 57, thus applying a braking torque proportional to this spring force on the rotating portion 45.

The rotating portion 45 includes a right cylindrical portion 62, a flange 63, and one rotation-stopping protrusion 64. The right cylindrical portion 62 is inserted into the one axial end 44 of the supply reel 43. The flange 63 is formed in one piece with the one axial end of the cylindrical portion 62. The rotation-stopping protrusion 64 protrudes outward in radial direction from the outer wall of the cylindrical portion 62 near the flange 63. The outer diameter D3 of the cylindrical portion 62 is the same as the outer diameter D1 of the second supporting member 46 at the supply reel fitting position where the supply reel 43 is completely inserted (D3=D1), and its length L2 is set to be larger than the distance L1 between the end face 60 of the other axial end 47 of the supply reel 43 and the bearing portion 61, which prevents false mounting of the first supporting member 46 and the second supporting member 48 on the axial ends on the supply reel 43.

The second supporting member 48, which has a plurality of trapezoid ribs 59 (four in this embodiment) that are provided in axial symmetry at 90° spacing, has roughly the shape of a quadrangular pyramid and is molded in one piece of a thermoplastic synthetic resin. The fourth supporting member 53 is configured like the second supporting member 48, and their axes are parallel.

The third supporting member 51 includes a right cylindrical portion 66, a flange 67, a gear wheel 68 for winding, and a plurality of rotation-stopping protrusions 69 (two in this embodiment). The right cylindrical portion 66 is inserted into the one axial end 50 of the winding reel 49. The flange 67 is formed in one piece with an intermediate portion in axial direction between both ends of the cylindrical portion 66. The winding gear wheel 68 is formed in one piece with the one axial end of the cylindrical portion 66. The rotation-stopping protrusions 69 protrude outward in radial direction from the outer wall of the cylindrical portion 66 near the flange 63, and are arranged at a certain spacing in circumferential direction. The outer diameter D4 of the cylindrical portion 66 is the same as the outer diameter D2 of the fourth supporting member 53 at the winding reel fitting position where the winding reel 43 is completely inserted (D4=D2), preventing false mounting of the third supporting member 51 and the fourth supporting member 53 on the axial ends of the winding reel 49.

Figure 3:
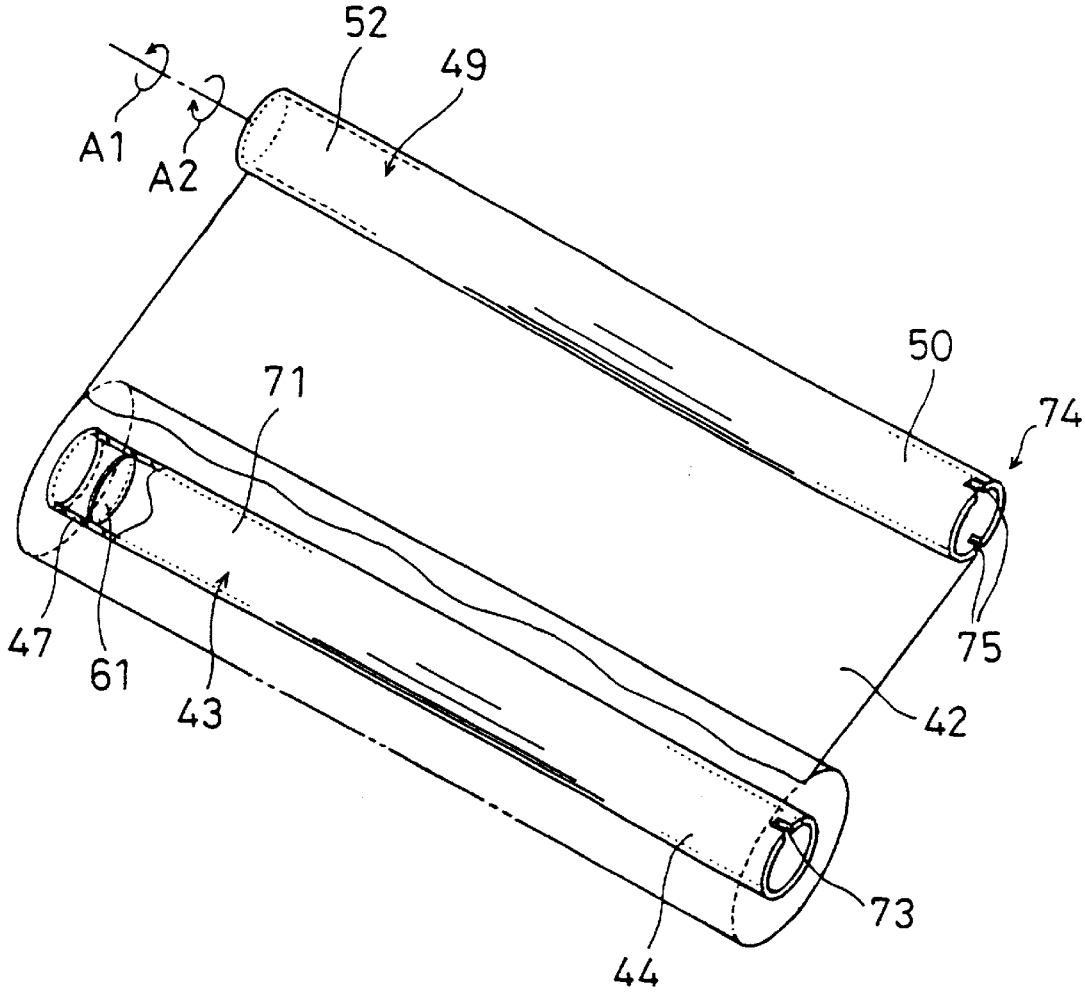
FIG. 3 is a perspective view showing the configuration of the supply reel and the winding reel.

FIG. 3 is a perspective view showing the configuration of the supply reel 43 and the winding reel 49. The supply reel 43 includes a supply reel body 71 that is roughly of right cylindrical shape and the afore-mentioned bearing portion 61, which is provided in one piece with the other axial end of the supply reel body 71, and is realized by an injection molded component of thermoplastic resin. In the one axial end 44 of the supply reel body 71, a cutout 73 is cut from the end face 72 toward the other axial end 47. The rotation-stopping protrusion 64 of the first supporting member 46 fits into this cutout 73, so that the rotation of the rotating portion 45 can be reliably transmitted.

The winding reel 49 is roughly of right cylindrical shape, and is realized by an injection molded component of thermoplastic resin or a paper mold component also referred to as a paper core. The one axial end 50 of the winding reel 49 is provided with two cutouts 75 that are cut from the end face 74 toward the other axial end 52 and that are arranged at a certain spacing in circumferential direction. The two rotation-stopping protrusions 69 of the third supporting member 51 are fitted into these cutouts 75, so that a rotation of the third supporting member 51 in the winding direction A1 can be reliably transmitted.

Figure 4:
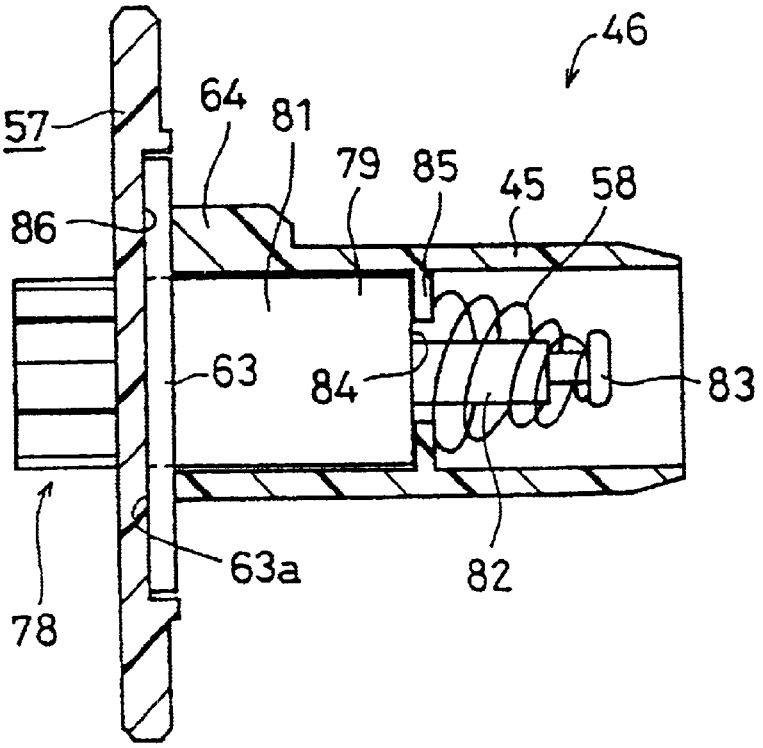
FIG. 4 is a magnified cross-sectional view showing the specific configuration of the first supporting member.
Figure 5:
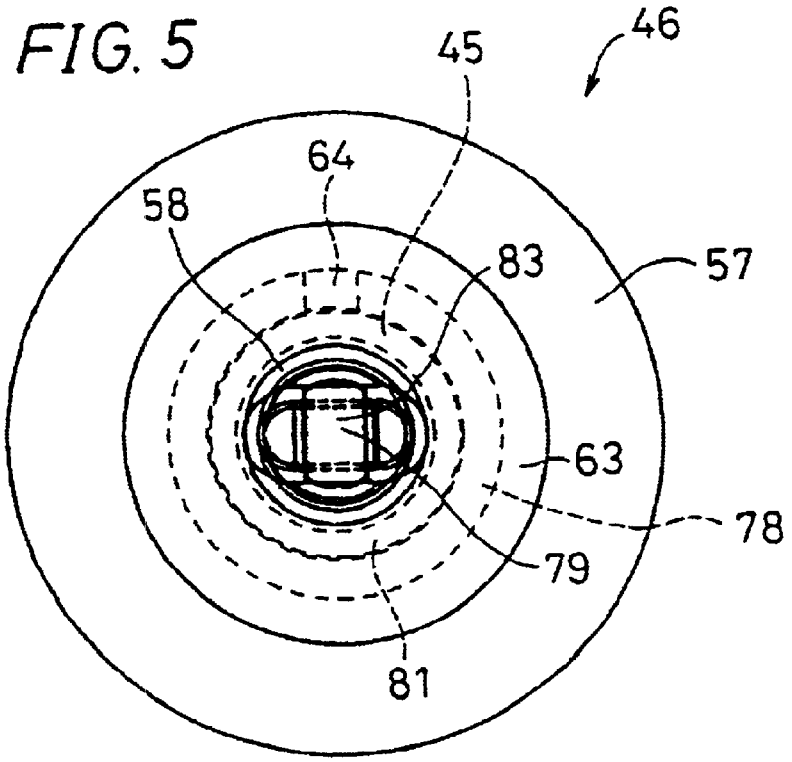
FIG. 5 is a front view of the first supporting member, taken from the right side of FIG. 4.

FIG. 4 is a magnified cross-sectional view showing the specific configuration of the first supporting member 46, and FIG. 5 is a front view of the first supporting member 46, taken from the right side of FIG. 4. As mentioned above, the first supporting member 46 includes a rotating portion 45, an open/close actuator 57 and a back tension spring 58. The rotating portion 45 and the open/close actuator 57 are made by injection molding of a sliding grade material of a thermoplastic resin, such as polyoxymethylene (POM) for example. The open/close actuator 57 includes a pinion 78 with a plurality of teeth formed into its outer circumference, and a stud 79 that is formed coaxially and in one piece with the pinion 78.

The stud 79 includes a substantially right cylindrical large-diameter axial portion 81, a small-diameter axial portion 82, and a substantially T-shaped spring receiver piece 83. A flange **78*a* is formed in one piece with the pinion 78 such that the pinion 78 us arranged on one surface of the flange 78*a*. The large-diameter axial portion 81 protrudes perpendicularly from the other surface of the flange 78*a*. The small-diameter axial portion 82 protrudes coaxially at the tip of the large-diameter axial portion 81. The spring receiver piece 83 is linked to the tip of the small-diameter axial portion 82. Between the small-diameter axial portion 82 and the large-diameter axial portion 81, a ring-shaped step surface 84 is formed that lies in a virtual plane that is perpendicular to the axis. One end of the back tension spring 58 mounted on the small-diameter axial portion 82 is fitted into and interlocks with the spring receiver piece 83, thus preventing the back tension spring 58** from coming off.

The rotating portion 45 is mounted on the stud 79. As mentioned before, the rotating portion 45 includes a right cylindrical portion 62, a flange 63 that is formed in one piece with the one axial end of the cylindrical portion 62, and a rotation-stopping protrusion 64 that protrudes from the base of the cylindrical portion 62 near the flange 63. The cylindrical portion 62 includes a ring-shaped inward flange 85 protruding radially inward from the inner wall of the cylindrical portion 62.

When the cylindrical portion 62 is mounted on the stud 79, this inward flange 85 is arranged on the free end side of the step surface 84, or in other words on the right side in FIG. 4. The other end of the back tension spring 58 abuts with its spring force against and is supported by the inward flange 85, and the cylindrical portion 62 is pressed at substantially constant pressure in the direction toward the pinion 78, whereby the flange 63 is pressed by the spring force against a ring-shaped sliding face 86 of the pinion 78.

Consequently, when the rotating portion 45 rotates around its axis while the rotation of the open/close actuator 57 is blocked, a braking torque in a direction opposite to the rotation direction acts on the flange 63 of the rotating portion 45, due to the sliding friction with the sliding face 86, thus applying a back tension to the ink film 42 and preventing wrinkles and slack. To give an example, in this embodiment the back tension of the ink film 42 is set to 60 gf·cm to 250 gf·cm, and preferably to 160 gf·cm±30 gf·cm.

This size of back tension can be adjusted by selecting the spring force of the back tension spring 58, but it is also possible to change the coefficient of dynamic friction between the sliding face 86 and the opposing surface 63*a* of the flange 63 by modifying the material or the sliding grade of the pinion 78 and the flange 63, or to achieve an optimum back tension on the ink film 42 by changing the contact area of the sliding face 86 and the opposing surface 63*a* of the flange 63.

Figure 6:
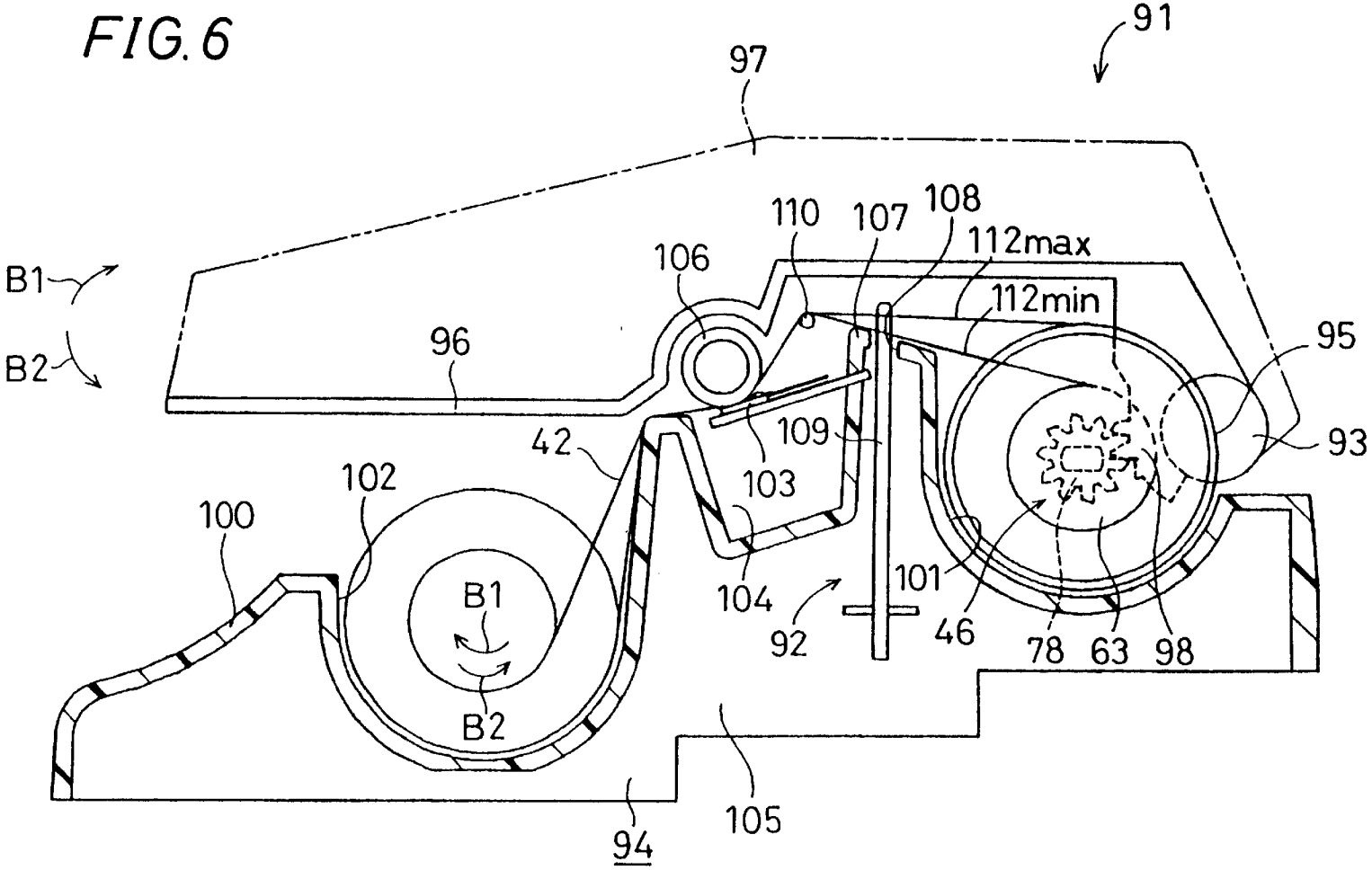
FIG. 6 is a simplified cross-sectional view of a printing apparatus to which the ink film holding device is mounted.
Figure 7:
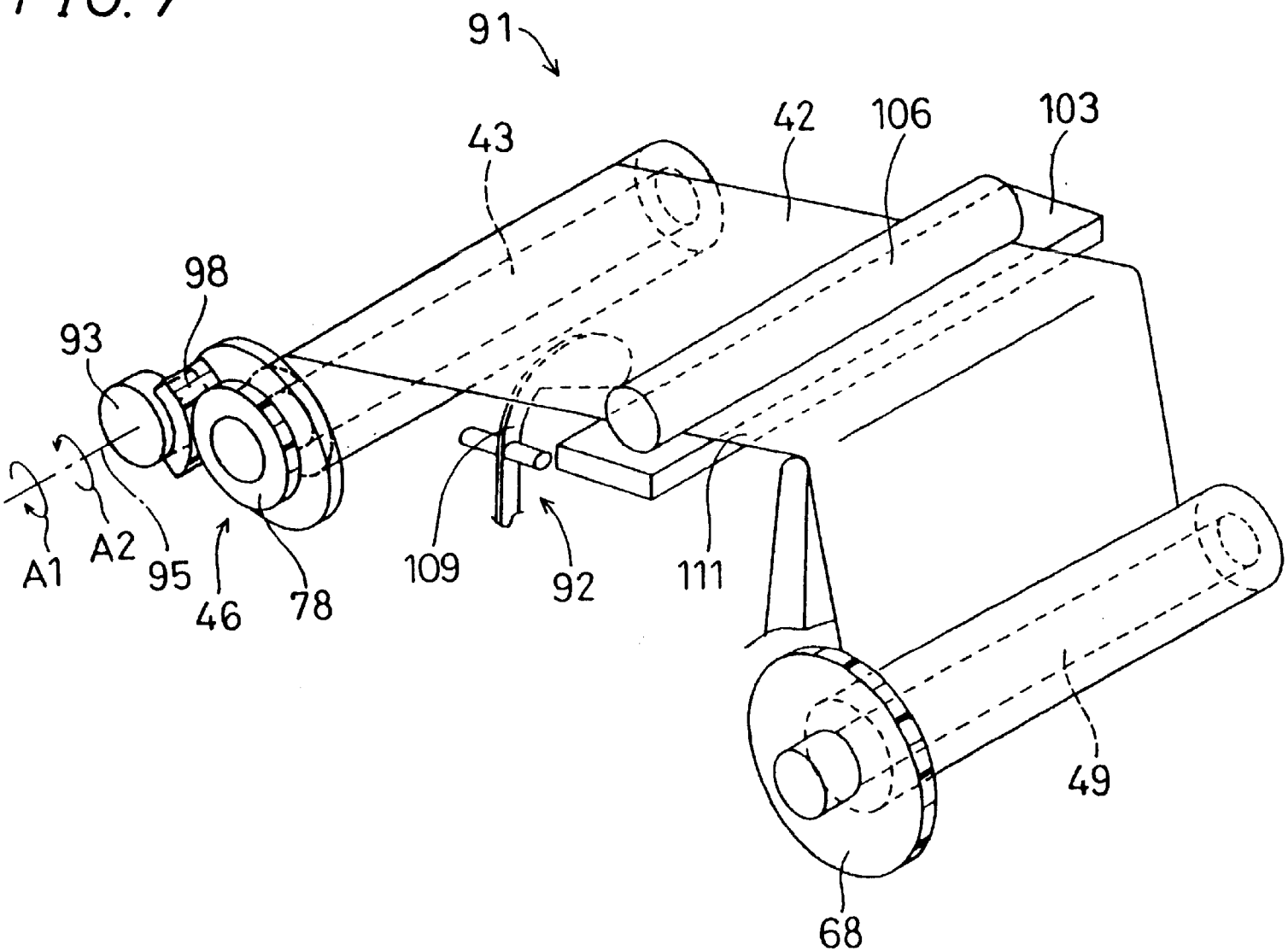
FIG. 7 is a simplified perspective view illustrating the configuration of an ink film detection portion of the printing apparatus.
Figure 8:
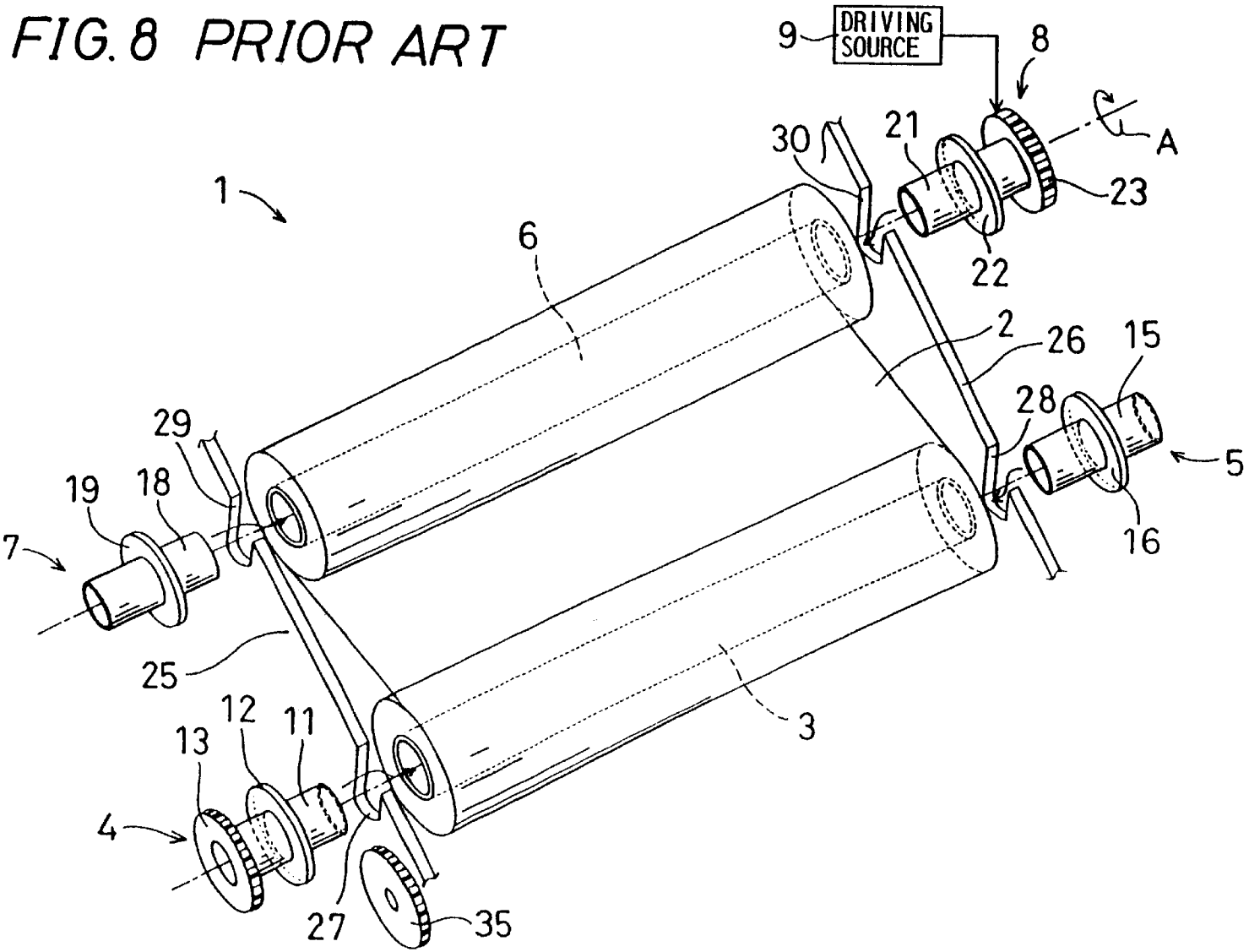
FIG. 8 PRIOR ART
FIG. 8 is an exploded perspective view showing an ink film holding device in accordance with conventional technology.

FIG. 6 is a simplified cross-sectional view of a printing apparatus 91 to which the ink film holding device 41 is mounted. FIG. 7 is a simplified perspective view illustrating the configuration of an ink film detection portion 92 of the printing apparatus 91. The ink film holding device 41 is mounted to the printing apparatus 91, which can be realized as a line printer-type thermal transfer printing apparatus mounted to a communications apparatus and an information processing apparatus having an image printing function, such as a facsimile, a printer or a copier.

The printing apparatus 91 includes an apparatus body 94 and a swinging lever 96, which is a coupling member that is linked by a pin 93 provided at its base end such that it can be angularly displaced around the axis 95 of the pin 93 in an opening direction B1 and a closing direction B2. The printing apparatus 91 is also provided with a lid 97 that covers from above the apparatus body 94 including at least the region accommodating the first supporting member 46.

The swinging lever 96 of the lid 97 is provided with a rack 98 that, as a result of an opening or closing operation, rotates the rotating portion 45 of the first supporting member 46 in a predetermined direction A2 unrolling the ink film when opening the lid, and rotates the rotating portion 45 of the first supporting member 46 in a winding direction A1 that is opposite to the unrolling direction A2 when closing the lid. This rack 98 meshes with the pinion 78 of the first supporting member 46, the rotation of the pinion 78 is transmitted via the flange 63, which is pressed against the sliding face 86 by the spring force of the back tension spring 58, to the cylindrical portion 62, so that the ink film 42 is slackened by rotating the supply reel 43 in the unrolling direction A2 when the lid 97 is opened, and tension is applied to the ink film 42 by rotating the supply reel 43 in the winding direction A1 when the lid 97 is closed.

The apparatus body 94 has a main case 100. This main case 100 includes a supply reel accommodating space 101, a winding reel accommodating space 102, and a print head accommodating space 104. The supply reel 43 around which the ink film 42 is wound is accommodated in the supply reel accommodating space 101, which is open to the top. The winding reel 49 around which the ink film 42 is wound is accommodated in the winding reel accommodating space 102, which is also open to the top. A print head 103 is accommodated in the print head accommodating space 104, which is provided between the supply reel accommodating space 101 and the winding reel accommodating space 102. Furthermore, the ink film detection portion 92 is provided in an internal space 105 inside the main case 100. The lid 97 is provided with a press roller 106 that, when the lid is closed, presses the ink film 42, which is spanned between the supply reel 43 and the winding reel 49, together with a sheet of paper (not shown in the drawings) with suitable contact pressure onto the print head 103.

The main case 100 has an upright portion 107 rising between the print head accommodating space 104 and the supply reel accommodating space 101. The ink film detection portion 92 is provided with a detection lever 109 that protrudes upward by spring force beyond an opening portion 108 in the upright portion 107. Arranged above the upright portion 107, this detection lever 109 is slightly depressed by a spanned portion 111 of the ink film 42 that is spanned between the supply reel 43 and a guide pin 110 provided on the apparatus body 94. As denoted by the reference marks 112max and 112min, when the detection lever 109 is pressed downward by the spanned portion 111 from a maximum winding state to a minimum winding state, it switches from on to off, or from off to on, so that it is possible to detect when the lid 97 has been closed and tension is applied on the ink film 42.

With the ink film holding device 41 of this embodiment configured as described above, the first supporting member 46 is mounted to the one axial end 44 of the supply reel 43, and the second supporting member 48 is mounted to the other axial end 47 of the supply reel 43. The third supporting member 51 is mounted to the one axial end 50 of the winding reel 49, and the fourth supporting member 53 is mounted to the other axial end 52 of the winding reel 49. The first supporting member 46 and the third supporting member 51 are supported rotatably about their axis by the first side plate 54, whereas the second supporting member 48 and the fourth supporting member 53 are fastened to the second side plate 55.

When the third supporting member 51 is rotated in a winding direction A1, its rotation is transmitted to the winding reel 49, the ink film 42 guided from the supply reel 43 is wound up, and due to the tension of the ink film 42, the supply reel 43 follows the rotation as well. In this situation, the rotating portion 45 of the first supporting member 46 rotates together with the supply reel 43, but since the back tension spring 58 exerts a braking force acts on the rotation of the rotating portion 45, the rotation of the supply reel 43 is braked, so that a tension force is generated in the ink film 42 spanning the supply reel 43 and the winding reel 49, applying a so-called back tension on the ink film 42. Thus, wrinkles or slack in the ink film 42 in the region in which the ink of the ink film 42 is transferred to the paper can be prevented, and printing defects such as displacements or irregularities in the printed image can be prevented.

This back tension is achieved with the first supporting member 46, so that it is not necessary to provide the apparatus body 94 of the printing apparatus 91 to which the holding device 41 is mounted with a back tension mechanism for braking the rotation of the supply reel 43. Consequently, space in the apparatus body 94 is not taken up by such a back tension mechanism, and it is possible to make the apparatus smaller. Furthermore, when the ink film 42 is exchanged, the task of detaching/attaching the other axial end 47 of the supply reel 43 and the second supporting member 48 as well as the task of detaching/attaching the other axial end 52 of the winding reel 49 and the fourth supporting member 53 are simplified because the second supporting member 48 and the fourth supporting member 53 are fastened to the second side plate 55, so that the task of exchanging the ink film 42 is made easier, improving the workability of the apparatus.

Because the bearing portion 61 on the other axial end 47, which is supported by the second supporting member 48 of the supply reel 43, is formed closer to the one axial end 44 than the other axial end 47, the bearing portion 61 is more receded to the one axial end 44 than the end face 60 of the other axial end 47 of the supply reel 43, and consequently, when the second supporting member 48 is fitted into the other axial end 47 of the supply reel 43, the other axial end 47 of the supply reel 43 is supported. Thus, the spacing between the end face 60 of the other axial end 47 of the supply reel 43 and the second side plate 55 on which the second supporting member 48 is provided can be reduced by the distance ΔL (see FIG. 1) that the bearing portion 61 is receded from the end face 60 of the other axial end 47 of the supply reel 43 toward the one axial end 44, the first and the second side plates 54 and 55 can be placed closer together, the space taken up by the holding device 41 can be reduced, and the printing apparatus 91 to which the holding device 41 is mounted can be made smaller.

Moreover, because the second supporting member 48 is tapered toward the first side plate 54 as described above, the other axial end 47 of the supply reel 43 can be easily mounted to the second supporting member 48, so that the supply reel 43 can be easily mounted when exchanging the ink film. Furthermore, by making the second supporting member 47 tapered, the bearing portion 61 is supported by the tip of the second supporting member 48, so that the rotation axis of the supply reel 43 matches the axis of the second supporting member 48, achieving a smooth rotation of the supply reel 43 preventing variations in the tension force on the ink film 42 spanned between the supply reel 43 and the winding reel 49, and decreasing printing defects.

Moreover, because the fourth supporting member 53 is also tapered, just like the second supporting member 48, the other axial end 52 of the winding reel 49 can be easily mounted to the fourth supporting member 53, facilitating the task of mounting the winding reel 49 when exchanging the ink film.

Furthermore, the outer diameter D1 of the second supporting member 48 at the supply reel fitting position is different from the outer diameter D2 of the fourth supporting member 53 at the winding reel fitting position, and the inner diameter d1 of the other axial end 47 of the supply reel 43 and the inner diameter d2 of the other axial end 52 of the winding reel 49 are formed slightly bigger than the outer diameter D1 of the second supporting member 48 at the supply reel fitting position and the outer diameter D2 of the fourth supporting member 53 at the winding reel fitting position, so that when trying to mount the supply reel 43 to the fourth supporting member 53 or when trying to mount the winding reel 49 to the second supporting member 48, an insertion is either impossible, or insertion is impossible but the fitting is too loose, so that the user easily recognizes the false mounting, and loading errors of the supply reel 43 and the winding reel 49 can be prevented.

Furthermore, since the second supporting member 48 and the fourth supporting member 53 are fastened to the second side plate 55, the task of detaching/attaching the second and fourth supporting members 48 and 53 from/to the supply reel 43 and the winding reel 49 when exchanging the ink film can be omitted, thus decreasing the number of parts that are mounted to or removed from the supply reel 43 and the winding reel 49 when exchanging the ink film, the operation can be simplified, and the workability of the ink film exchange is improved.

Furthermore, since the lid 97 of the printing apparatus 91 is provided with a rack 98 serving as an engaging member, the rotating portion 45 of the first supporting member 46 is rotated in the unrolling direction A2 by the opening of the lid 97 when exchanging the ink film, and the spanned portion 111 of the ink film 42 that is spanned between the supply reel 43 and the winding reel 49 can be slackened. Moreover, when the ink film 42 has been exchanged and the lid 97 is closed, the rotating portion 45 of the first supporting member 46 is rotated in the winding direction A1 by the rack 98, applying a tension to the spanned portion 111 of the ink film 42 that is spanned in a slackened state between the supply reel 43 and the winding reel 49, so that it is possible to prevent wrinkles and slack in the ink film 42 before the following printing operation begins.

As another embodiment of the invention, it is also possible to make the inner diameter of the one axial end 44 of the supply reel 43 larger than the inner diameter d1 of the other axial end 47 (d3>d1), and prevent false mounting of the first and second supporting members 46 and 48 to the two axial ends 44 and 47 of the supply reel 43.

As yet another embodiment of the invention, it is also possible that the first and the third supporting member 46 and 51 are mounted to the first side plate 54, and the first axial ends 44 and 50 of the supply reel 43 and the winding reel 49 are mounted to the first and the third supporting member 46 and 51 in one unit. Thus, the task of exchanging the ink film can be simplified and accelerated.

As yet another embodiment of the invention, it is also possible that in addition to attaching the supply reel 43 and the winding reel 49 via the first and third supporting members 46 and 51 to the first side plate 54, the second and fourth supporting members 48 and 53 fastened to the second side plate 55 are mounted to the other axial ends 47 and 52 of the supply reel 43 and the winding reel 49 in one unit. Thus, the task of exchanging the ink film can be simplified and accelerated even more.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An ink film holding device comprising:

a supply reel around which an ink film is wound;

a first supporting member that is mounted detachably to one axial end of the supply reel and includes a rotating portion that is fitted to the one axial end of the supply reel and means for generating a braking force, which includes the rotating member, with respect to rotation around an axis of the supply reel;

a second supporting member that is mounted detachably to a second axial end of the supply reel, for supporting the second axial end of the supply reel such that the second axial end is rotatable about the axis of the supply reel;

a winding reel that is arranged parallel to the supply reel, for winding up the ink film that is guided to the winding reel from the supply reel;

a third supporting member that is mounted detachably to one axial end of the winding reel and is rotated in a predetermined winding direction;

a fourth supporting member that is mounted detachably to a second axial end of the winding reel, for supporting the second axial end of the winding reel such that the second axial end is rotatable about an axis of the winding reel;

a first side plate for supporting the first supporting member and the third supporting member such that the first and third supporting members are rotatable about their respective axes; and a second side plate to which the second supporting member and the fourth supporting member are fastened;

wherein the means for generating a braking force is effective to tension the ink film between the supply reel and the winding reel so that wrinkles or slack of the ink film are prevented.

2. The ink film holding device of claim 1, wherein the supply reel is provided with a bearing portion that is rotatably supported by the second supporting member.

3. The ink film holding device of claim 1, wherein the second supporting member is tapered as it protrudes from the second side plate.

4. The ink film holding device of claim 1, wherein the fourth supporting member is tapered as it protrudes from the second side plate.

5. The ink film holding device of claim 1, wherein an outer diameter of the second supporting member at a fitting position where the second supporting member is completely mounted to the second axial end of the supply reel is different from the outer diameter of the fourth supporting member at a fitting position where the fourth supporting member is completely mounted to the second axial end of the winding reel, and an inner diameter of the second axial end of the supply reel and an inner diameter of the second axial end of the winding reel are formed slightly bigger than the outer diameter of the second supporting member at the supply reel fitting position and the outer diameter of the fourth supporting member at the winding reel fitting position.

6. The ink film holding device of claim 1, wherein the second side plate is fastened to an apparatus body of an apparatus for printing using the ink film.

7. The ink film holding device of claim 6, wherein the apparatus body is provided with an openable lid for covering at least a region accommodating the first supporting member, and the lid is provided with an engaging member that rotates the rotating portion of the first supporting member in a predetermined direction unrolling the ink film when opening the lid, and rotates the rotating portion of the first supporting member in a winding direction that is opposite to the unrolling direction when closing the lid.

8. The ink film holding device of claim 1, wherein the inner diameter of the one axial end of the supply reel is larger than the inner diameter of the second axial end of the supply reel.

9. The ink film holding device of claim 1, wherein the supply reel and the winding reel are mounted at least to the first side plate together with the first supporting member and the third supporting member and formed in one unit.

10. The ink film reel of claim 1, wherein the means for braking includes a flange on the rotating portion and a compression spring and the wrinkles or slack in the ink film are prevented at a position where ink is transferred in the ink film to an image.

11. An ink film reel comprising:

a right cylindrical reel body around which an ink film is wound, two axial ends of the reel body being supported by a supporting member on an apparatus body of an apparatus for printing with the ink film, so as to rotate around an axis of the reel body, wherein one axial end of the reel body is provided with a bearing portion that is more receded to a second axial end than an end face of the one axial end, and that is supported rotatably about the axis of the reel body by a tip of the supporting member.

12. The ink film reel of claim 11, wherein the ink film reel is made of a thermoplastic synthetic resin.

* * * * *